US006276027B1

(12) United States Patent
Hanna

(10) Patent No.: US 6,276,027 B1
(45) Date of Patent: Aug. 21, 2001

(54) SWING-UP GRAB BAR

(75) Inventor: Emmanuel A. Hanna, Lakeview Terrace, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 0 days.

(21) Appl. No.: 09/336,034

(22) Filed: Jun. 18, 1999

(51) Int. Cl.[7] ..... A47K 17/02

(52) U.S. Cl. ..... 16/436; 16/438; 16/430; 16/901

(58) Field of Search ..... 16/436, 438, 445, 16/110.1, 430, 286, 289, 256, 290, 291, 342, 338, 337, 339; 211/700; 4/254, 576.1, 577.1, 611

(56) References Cited

U.S. PATENT DOCUMENTS

| | | | | |
|---|---|---|---|---|
| 823,372 | | 6/1906 | Stevens et al. . | |
| 1,131,659 | * | 3/1915 | Boomer | 16/126 |
| 2,059,171 | | 10/1936 | Harris . | |
| 3,228,038 | | 1/1966 | Augustine . | |
| 3,286,283 | | 11/1966 | Bertoldo . | |
| 3,562,849 | | 2/1971 | Brayshaw . | |
| 4,657,233 | * | 4/1987 | Vroom | 16/111 R |
| 4,908,906 | | 3/1990 | Hanna . | |
| 4,982,453 | * | 1/1991 | Matsumoto | 16/342 |
| 5,142,738 | * | 9/1992 | Ojima | 16/342 |
| 5,590,440 | * | 1/1997 | Pelt et al. | 16/111 R |

FOREIGN PATENT DOCUMENTS 1964410 7/1971 (DE) .

* cited by examiner

*Primary Examiner*—Chuck Y. Mah
*Assistant Examiner*—Enoch E. Peavey
(74) *Attorney, Agent, or Firm*—Christie, Parker & Hale, LLP

(57) ABSTRACT

The present invention provides an ambulatory assistance device such as a grab bar or the like which pivots between a non-in-use and an in-use position. The pivoting of the device is assisted by a torsion member acting between the base member and the body. The torsion device is selected so as to retain the body in its non-in-use position when placed in that position. The weight of the pivoting body of the present invention overcomes the force generated by the torsion member when the body is placed in the in-use position so as to retain that orientation. Moreover, the torsion member acts to assist the user of the device in counteracting the weight of the pivoting body member when the body member is moved between the non-in-used position and the in-use position.

2 Claims, 2 Drawing Sheets

36
18
10
12
3
40
2
3
V
36
14
16
D
2
38

SWING-UP GRAB BAR

BACKGROUND

The present invention relates to an ambulatory assistance device, and more particularly to an ambulatory assistance device such as a grab bar or the like which may be pivoted between an in-use position and a non-in-use stored position.

As is known to persons who design and equip facilities which are usable by the general public, it is highly desirable and oftentimes necessary to provide ambulatory assistance devices. Although these devices are probably most commonly used by persons having ambulatory handicaps, these devices may also be used by anyone who requires or merely feels the need for ambulatory assistance.

One device which is known to persons in the art for providing this type of assistance is commonly referred to as a grab bar device. While some of the prior devices are arranged such that the device may swing or pivot aside when it is not in-use, none of these devices provide a grab bar device or the like which may swing or pivot between a non-in-use position and an in-use position wherein the device will maintain its selected position or orientation without the use of an auxiliary locking mechanism or which requires the user to move the device through some other locking motion.

SUMMARY OF THE PRESENT INVENTION

The present invention provides an ambulatory assistance device such as a grab bar device or the like which can swing or pivot between a non-in-use position and an in-use position. The present invention acts to maintain its selected position or orientation without relying upon an auxilary locking mechanism or a friction device, or requiring the user of the device to move it through a secondary locking motion. Accordingly, it is an object of the present invention to provide an ambulatory assistance device such as a grab bar or the like which may be moved between a non-in-use position and an in-use position and which will retain the selected position or orientation without relying upon an auxiliary locking mechanism or a friction device, or requiring the user of the device to move it through a secondary motion in order to lock it in the selected position.

It is a further object of the present invention to provide an ambulatory assistance device that is easy to assemble and readjust for torsional springs of various torque strengths.

It is a further object of the present invention to provide an ambulatory assistance device wherein the biasing springs are adjustable to increase or decrease torque to accommodate various sizes of grab bars.

It is a further object of the present invention to provide an ambulatory assistance device such as a grab bar or the like which may be easily moved between a non-in-use position and an in-use position by the user of the device. Other and more detailed objects of the present invention will become apparent to those skilled in the art upon examination of the disclosure contained herein.

DETAILED DESCRIPTION OF THE PREFERRED EMBODIMENT

Figure 1:
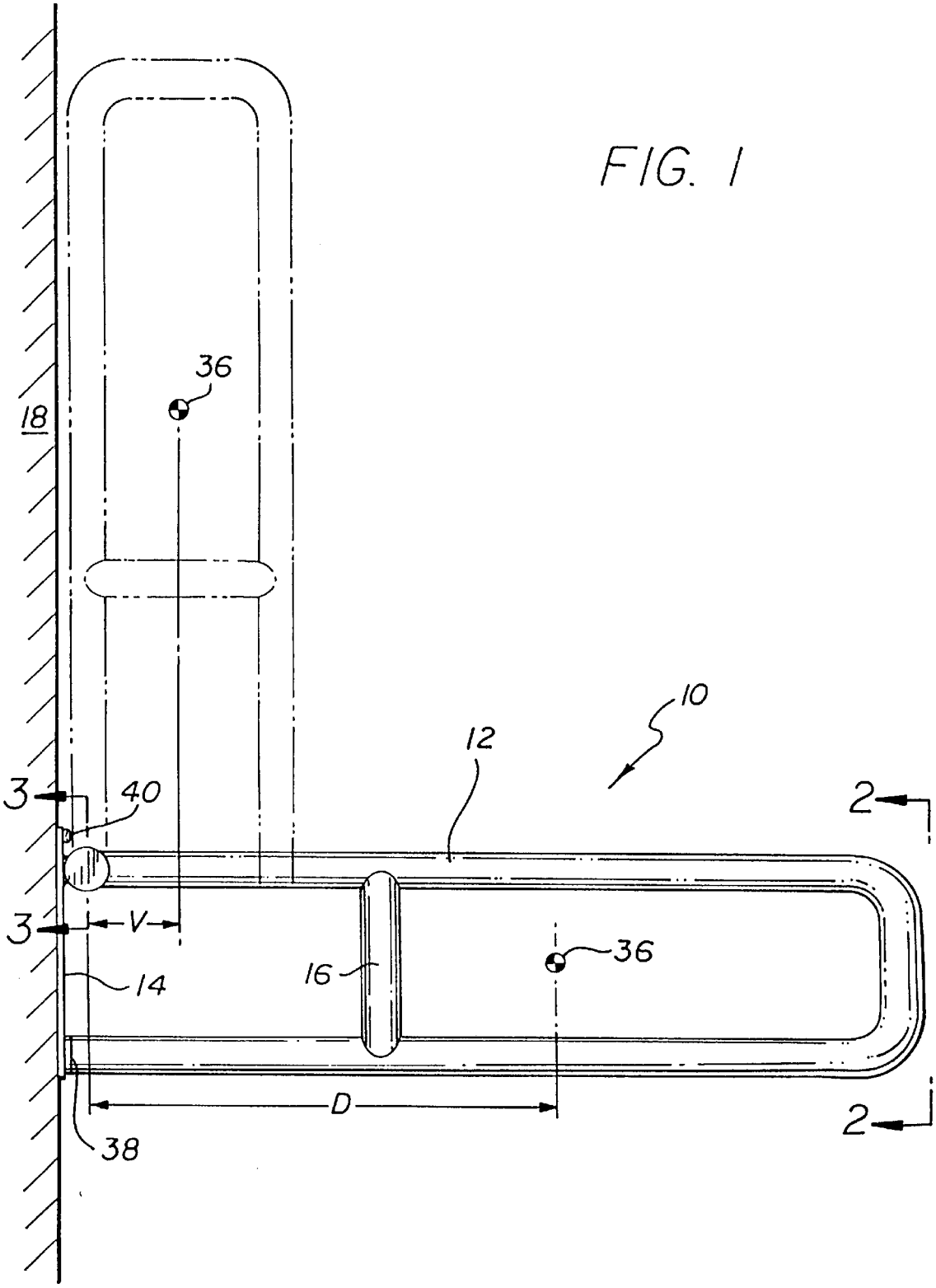
FIG. 1 is a side view of a preferred embodiment of the present invention shown in the in-use position with the non-in-use position shown in phantom.
Figure 2:
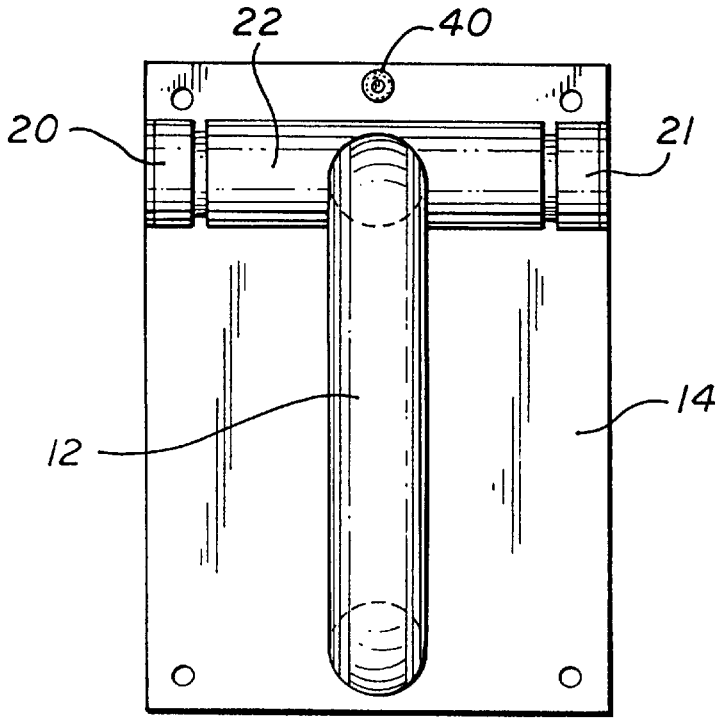
FIG. 2 is a front view of a preferred embodiment of the present invention shown from substantially along line 2—2 of FIG. 1.
Figure 3:
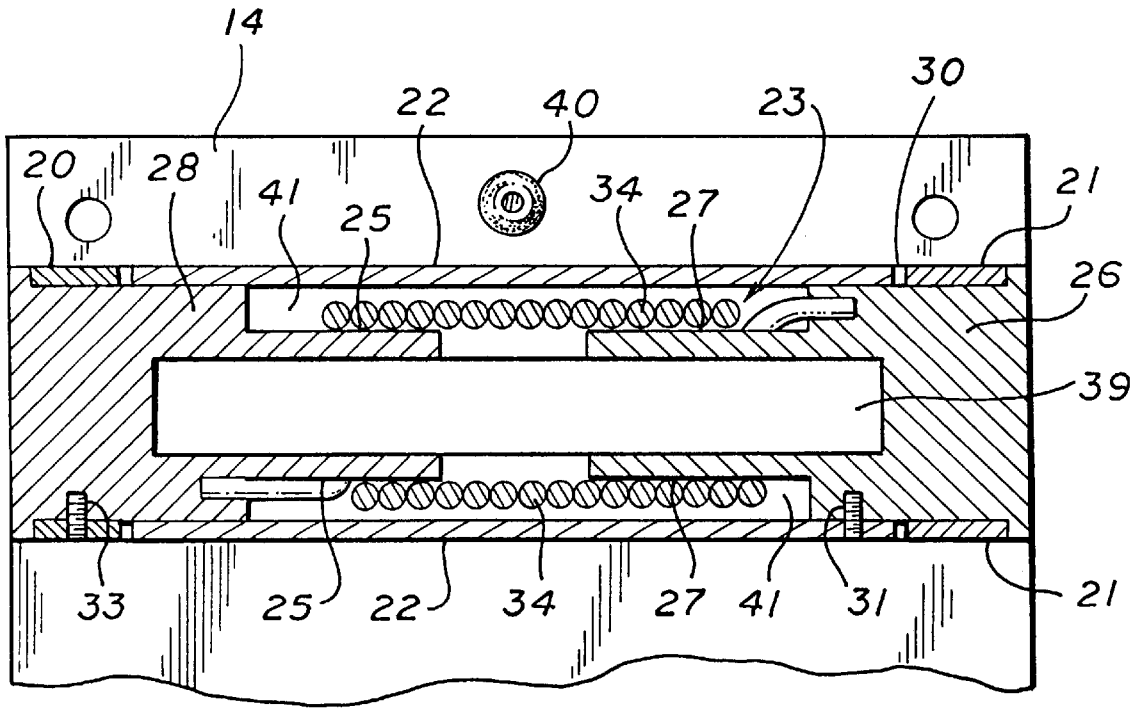
FIG. 3 is a sectional view of a portion of the preferred embodiment of the present invention shown substantially along line 3—3 of FIG. 1.

As is illustrated by the figures, the preferred embodiment of the present invention is a grab bar device 10 or the like which includes a body 12 pivotally connected to a base member 14. In the preferred embodiment of the present invention, the body 12 is substantially U-shaped and includes a cross link 16 to provide the body 12 with additional structural support and rigidity. In addition, the body 12 is arranged in such a manner as to provide the user with a variety of places to grip the device. Thus, in addition to being simple to manufacture and use, the preferred embodiment of the present invention includes the ability to be gripped in an almost unlimited number of places by the user, including along the cross link member. The user may conveniently use the grab device 10 as a handle for assisting in sitting down or arising from a seat, such as a toilet, positioned adjacent the device 10. As will be well understood to those skilled in the art, however, alternative body figurations and uses are easily possible without departing from the scope of the present invention.

The base member 14 is adapted to be connected to a wall 18 or some other independent structural member of sufficient strength so as to permit the present invention to be used as an ambulatory assistance device. Although the preferred embodiment of the present invention illustrates a single base member 14 pivotally connected to the body 12, additional base members could be connected to alternative body constructions without departing from the teachings of the present invention.

In order to pivotally mount the body 12 to the base member 14, the preferred embodiment of the present invention includes first and second fixed rings 20, 21 rigidly affixed to the base member 14. A support collar 22 is rigidly affixed to a first end of the body 12. The support collar is pivotally supported by a stationary bushing 28 and a rotating bushing 26 longitudinally spaced apart and disposed between said fixed rings. Each bushing 28, 26 has annular extensions 25, 27 (respectively) forming an annular space 39 in between said bushings and a cavity 41 between said bushings and said collar 22 encircling said bushings. The stationary bushing 28 is secured to the first fixed ring 20 and the base plate 14 by a first set screw 33 while the rotating bushing 26 is connected to the collar 22 by a second set screw 31. Optionally, a hollow tube may be placed within the cavity 41 formed between the annular extensions of the two bushings 26, 28 so as to further strengthen the construction of the grab bar.

A torsion device 23 is preferably provided between the rotatable support collar 22 and the fixed rings 20, 21. In the preferred embodiment, torsion device is a torsional spring 34 that wraps around the annular extensions 25, 27 of the fixed rings within the cavity 41 and is attached at one end to the stationary bushing 28 and on the opposite end to the rotating bushing 26. While being assembled, the rotating bushing 26 may be rotated until a sufficient amount of torque is achieved before being secured by the second set screw 31. This feature permits easy adjustment of the torsional spring force to compensate for the varying spring constants found in torsional springs and to provide different torque for the springs as needed for grab bars of various dimensions.

An upper bumper 40 is provided on the base member 14 and is arranged so as to keep the grab bar device from hitting the wall 18 when the device is in the pivoted non-in use position. A similar bumper or stop 38 is provided over the free second end of the device body 12 for engaging the base member 14 to stop the body 12 in a horizontal in-use position for supporting the users weight or force on the body 12. The bumper 38 also protects the user of the device from possible injury when the body 12 is provided upwardly. Two collars 30 encircle the annular extension 26 and are positioned between the pivoting body 12 and the fixed rings 20, 21 to eliminate friction and provide for smoother movement of the body.

The body 12 of the present invention has a center of gravity 36 which may be determined either empirically or experimentally. As is best illustrated in FIG. 1, the body center of gravity 36 will have a first moment arm "V" when the device is in the pivoted upwardly to the non-in-use position and a second moment arm "D" when the device is in the substantially extended or downward in-use position. When selecting the torsion means 23, it is necessary to evaluate the weight of the body 12 and the length of these moment arms V and D. The selection of the torsion means 23, and particularly the torsion spring 34 of the preferred embodiment of the present invention, may be determined as follows.

In selecting the torsion member for use with the present invention, it is necessary to determine the torque associated with the pivoting body of the present invention, including the body member 12 and any associated elements or members connected thereto and pivoting therewith such as the crosslink member 16 as they pivot between the device in-use down position and the device non-in-use up position. This torque may be calculated by multiplying the weight of the pivoting body by the distance between the center of gravity and the pivot point. In order to maintain the bar in the stored non-in-use up position without any latching mechanism, the torque provided by the torsion member 23 in the counterclockwise direction, as viewed in FIG. 1, must be greater than the clockwise torque produced by the weight of the pivoting body when the device is in the non-in-use stored position.

Similarly, it is possible to calculate or measure the clockwise torque produced by the weight of the pivoting body when it is in the substantially in-use downwardly pivoted position. In order to insure that the device will stay in the in-use pivoted position when it is moved to that position by the user of the device 10, the counterclockwise torque provided by the torsion member 23 must be less in the in-use position than the clockwise torque produced by the weight of the pivoting body. By such an arrangement, the torque produced by the weight of the pivoting body will be sufficient to retain the device in the substantially downward position when the user so positions the device. In addition, the torsion member will act to assist the user of the device in pivoting the present invention between the non-in-use position and the in-use position such that the ambulatory assistance device of the present invention may be pivoted quite easily. Friction forces between any adjacent parts of the present invention assist the torsion device in increasing the stability of the present invention to remain in any selected position.

For purposes of example, in one embodiment of the present invention, the body member 12 and the cross link 16 were constructed from a U-shaped 1¼ inch diameter stainless steel tubing to extend outwardly from the wall 32" in the down position. The resultant body 12 had a weight of 3.65 lbs. The support collar 22 was constructed from a 1½ inch diameter stainless steel tube which was welded to one end of the U-shaped body member 12. The diameter of the optional hollow tube is approximately ⅝ inches with the annular space slightly larger. The length of the annular space in the preferred embodiment is three inches. By this construction, the moment arm U was 3.35 inches and the moment arm D was 15.77 inches. Thus the weight-produced torque was 12.2 in the up position and 57.5 in-lbs. in the down position. Thus the torsion member 23 was required to produce more than 12.2 in lbs. in the up position and less than 57.5 in lbs. in the down position, i.e., after 90° degree downward rotations.

In this embodiment, the torsion spring 34 was chosen as the torsion member 23 and the spring constant was selected to produce the desired torque, as described above. The spring extended from the plastic stationary bushing 28 at one end to the rotating bushing 26 at the other end. The stationary bushing 28 was secured to the fixed ring 20 by the first set screw 33. Similarly, the rotating bushing 26 was secured to the rotating support collar 22 by the second set screw 31. The torsion spring 34 was connected to the rotating bushing 26 at one end and to the stationary bushing 28 at the other end by inserting each end of the spring into a hole in the respective bushing.

As stated above, the spring acted to counteract the torque produced by the weight of the pivoting body when the device was in the pivoted non-in-use position to hold the body in the upward, non-in-use position while permitting the torque produced by the pivoting body to overcome the force of the torsional spring 34 when grab bar device was in the horizontal in-use position to allow the body 12 to remain in the downward in-use position. Moreover, the spring acted to counteract the weight of the body of the device during the rotation stroke between the non-in-use position and the in-use position so as to permit the easy and convenient use of the device of the present invention.

It is believed that the present invention provides a simple yet reliable device which may be easily operated by persons who need the assistance of an ambulatory assistance device such as a grab bar or the like according to the present invention. Moreover, it is believed that the teachings of the present invention are equally applicable to other devices wherein it is desirable to have the device easily pivot between a non-in-use position and an in-use position. Accordingly, although a preferred embodiment of the invention is described herein, persons skilled in the art will understand that the present invention may be applied to other devices without departing from the teachings hereof. Accordingly, the scope of this invention is limited only by the claims appended hereto.

I claim:

1. A grab bar for use by a handicapped person for ambulatory assistance, comprising:

a substantially U-shaped body lying in a vertical plane, said body including at least one cross link member to increase the stability and rigidity of said body, said body being arranged so as to have a plurality of gripping surfaces;

a base member, said base member including first and second fixed rings;

first and second bushings disposed between said fixed rings with annular extensions forming an annular space therebetween, said body being arranged for gripping by a person to pivot said body about said bushings;

a torsion member, said torsion member including a torsion spring, said torsion spring being arranged around said annular extensions to provide torsional force between said body member and said base member;

said body being pivotable by the person using the grab bar between a horizontally extending position wherein the weight of the body retains the body in that position in opposition to the torsion spring after release by the person and a vertically extending position wherein the torsion spring retains the body in that vertically extending position in opposition to the weight of the body after release by the person; and wherein said body has a collar encircling said annular extensions forming a cavity that said torsion spring is disposed within, said first bushing connected to said first fixed ring and rotatably supporting a first end of said collar, and said second bushing connected to a second end of said collar and rotatably supported on said second fixed ring.

2. The grab bar of claim 1 further comprising a hollow shaft housed in the annular space between said bushings.

* * * * *